US008029116B2

(12) United States Patent
Liu

(10) Patent No.: US 8,029,116 B2
(45) Date of Patent: Oct. 4, 2011

(54) INK CARTRIDGE

(76) Inventor: Jiajin Liu, Zhuhai (CN)

( * ) Notice: Subject to any disclaimer, the term of this patent is extended or adjusted under 35 U.S.C. 154(b) by 485 days.

(21) Appl. No.: 12/282,588

(22) PCT Filed: May 16, 2006

(86) PCT No.: PCT/CN2006/000999

§ 371 (c)(1),
(2), (4) Date: Nov. 17, 2008

(87) PCT Pub. No.: WO2007/104187

PCT Pub. Date: Sep. 20, 2007

(65) Prior Publication Data

US 2009/0244219 A1 Oct. 1, 2009

(51) Int. Cl.
*B41J 2/175* (2006.01)

(52) U.S. Cl. ..... 347/86

(58) Field of Classification Search ..... 347/86, 347/84–85, 87, 89, 93

See application file for complete search history.

(56) References Cited

U.S. PATENT DOCUMENTS

| | | | |
|---|---|---|---|
| 5,821,965 | A | 10/1998 | Oda et al. |
| 5,821,966 | A | 10/1998 | Schell et al. |
| 5,971,531 | A | 10/1999 | Dietl et al. |
| 6,062,684 | A | 5/2000 | Sasaki |
| 6,422,691 | B2 | 7/2002 | Kobayashi et al. |
| 6,644,796 | B2 | 11/2003 | Olsen |

FOREIGN PATENT DOCUMENTS

| | | | |
|---|---|---|---|
| CN | 2732484 | Y | 10/2005 |
| CN | 2822967 | Y | 10/2006 |
| EP | 0 949 080 | A2 | 10/1999 |
| JP | 9-240004 | A | 9/1997 |
| JP | 11-10905 | A | 1/1999 |
| JP | 2001-246762 | A | 9/2001 |

OTHER PUBLICATIONS

The International Search Report for International Appl. No. PCT/CN2006/000999, completed Nov. 16, 2006.

*Primary Examiner* — Kristal Feggins
(74) *Attorney, Agent, or Firm* — Alston & Bird LLP

(57) ABSTRACT

The present invention provides an ink cartridge including a cartridge body defining an air vent at an upper section thereof and an ink discharge port detachably assembled to a lower section of the cartridge body. The cartridge body and/or the ink discharge port can be replaced separately when they are damaged and, thus, there is no need to replace the ink cartridge as whole.

8 Claims, 5 Drawing Sheets

INK CARTRIDGE

BACKGROUND OF THE INVENTION

1. Field of the Invention

The present invention generally relates to consumables of printers, and more particularly, relates to an ink cartridge.

2. Description of Related Art

Ink cartridge is an important consumable for use in printers. An ink cartridge typically includes a cartridge body defining an air vent at an upper section thereof and an ink discharge port securely fixed to a lower section of the cartridge body.

When the cartridge body or the ink discharge port is damaged due to abrasion, the ink cartridge has to be replaced as a whole, which will inevitably lead to considerable wastefulness and serious pollution. Even though the ink cartridge can be repeatedly filled with ink after the ink is used up, the ink cartridge still has to be replaced as a whole when the cartridge body or the ink discharge port is damaged.

SUMMARY OF THE INVENTION

Therefore, one object of the present invention is to provide an ink cartridge having an ink discharge port and/or an ink accommodating body which can be separately replaced when the ink is used up, or the ink discharge port and/or the ink accommodating body is damaged.

According to one embodiment of the present invention, an ink cartridge of the present invention includes a cartridge body having an air vent at an upper section thereof and an ink discharge port detachably assembled to a lower section of the cartridge body. The ink discharge port or the ink accommodating body can be separately replaced by a new one when they are damaged and, consequently, there is no need to replace the ink cartridge as a whole.

Preferably, the cartridge body includes a base and an ink accommodating body removably coupled to the base. The ink accommodating body defines an opening corresponding to the ink discharge port. When the ink is used up, the ink accommodating body can be disassembled and filled with ink repeatedly. There is no need to replace the ink cartridge as a whole when the cartridge body and/or the ink accommodating body is damaged.

Preferably, the ink discharge port is provided with a filter tip and a sealing member having a cone-shaped hole at upper and lower sides thereof, respectively. The filter tip is formed with a filter screen and/or a ceiba fibre. Therefore, perfect filter effect of the filter tip is realized and there is no need to provide with a sealing membrane.

Preferably, the filter tip is provided with an elastic gasket to prevent leakage between the filter tip and the opening defined at lower section of the ink accommodating body.

Preferably, a protecting shield formed with an elastic sealing gasket is seated on the opening, so as to improve the sealing effect.

Preferably, the ink accommodating body defines an empty chamber and a storage chamber in communication with the empty chamber. The empty chamber and the storage chamber each define an air vent at a top thereof. The opening is located at a lower section of the storage chamber filled with sponge and/or fibre cotton. Therefore, ink can be filled into the empty chamber conveniently.

Preferably, the ink accommodating body is coupled to the base in a lock joint manner. The protecting shield is coupled to the opening in a lock joint manner. Therefore, it is very convenient for the user to assemble the ink cartridge or replace components of the ink cartridge.

Preferably, a sealing cover made from elastic material is provided on the ink discharge port for facilitating operation of the user.

Preferably, the base is formed with a chip thereon, so as to facilitate control of ink consumption and remind user to deal with on time when ink is about to be used up.

Preferably, the cartridge body forms a handle. The ink accommodating body is made from transparent material. Graduation line is set on side wall enclosing the empty chamber. Therefore, it is convenient for a user to manipulate the ink cartridge and fill the ink accommodating body with ink.

Preferably, the ink cartridge can be a unicolor split-type ink cartridge or a multicolor assembly-type ink cartridge.

Employing the ink cartridges according to the present invention as previously described, the cartridge body and the ink discharge port can be separately replaced when the ink discharge port or the cartridge body is damaged and, therefore, there is no need to replace the ink cartridge as a whole.

Other advantages and novel features of the present invention will become more apparent from the following detailed description of embodiments as taken in conjunction with the accompanying drawings.

BRIEF DESCRIPTION OF THE DRAWINGS

Many aspects of the ink cartridge in accordance with the present invention can be better understood with reference to the following drawings. The components in the drawings are not necessarily drawn to scale, the emphasis instead being placed on clearly illustrating the principles of the present ink cartridge.

DETAILED DESCRIPTION OF THE INVENTION

Figure 1:
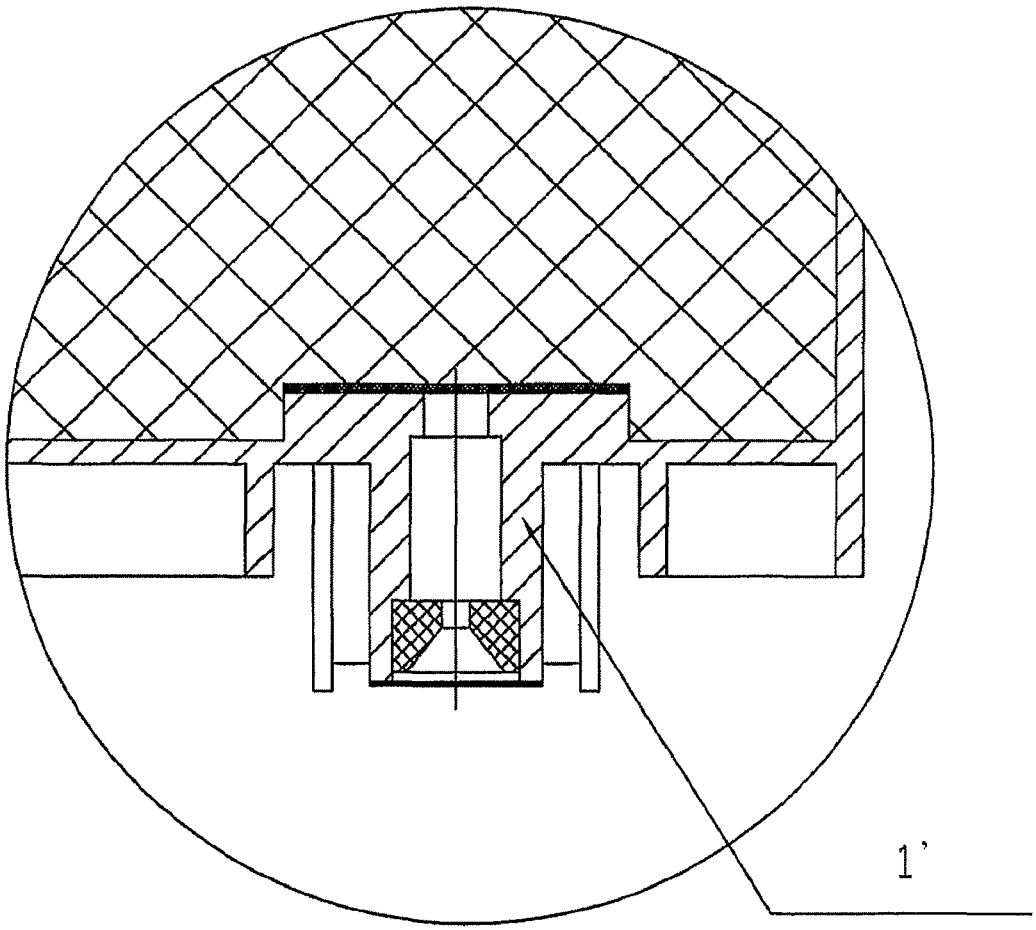
Fig. 1 (PRIOR ART)
FIG. 1 depicts a partial sectional view of a conventional ink cartridge.

Referring to FIG. 1, an ink discharge port 1' in a conventional ink cartridge can not be disassembled from a cartridge body (not labeled) of the ink cartridge. When the ink discharge port 1' or the cartridge body is damaged due to normal abrasion, the ink cartridge has to be discarded and/or replaced as a whole, which will inevitably lead to remarkable wastefulness and serious pollution.

Figure 2:
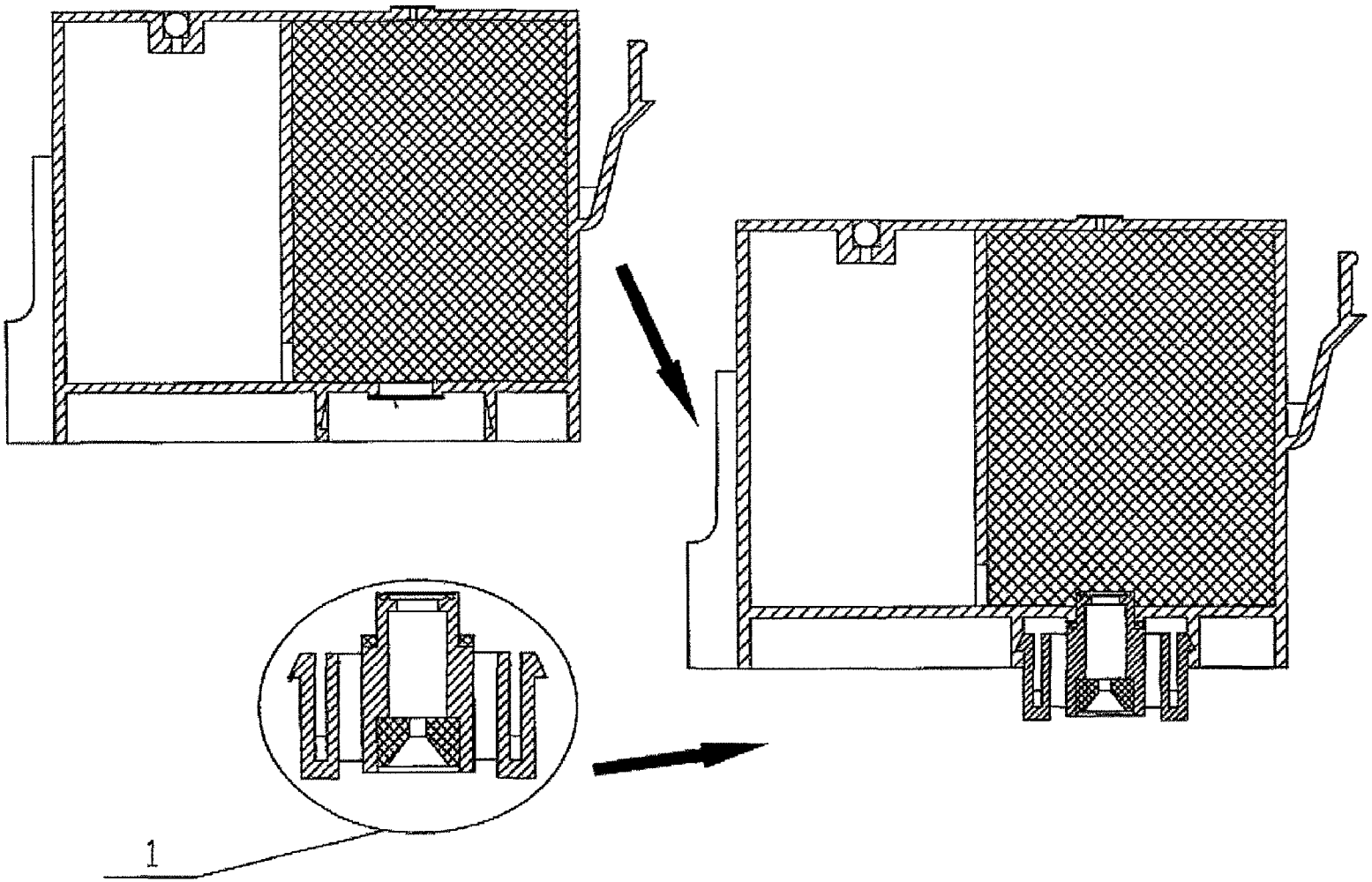
FIG. 2 depicts a sectional view of an ink cartridge in accordance with a first embodiment of the present invention.

Referring to FIG. 2, an ink cartridge according to a first embodiment of the present invention includes a cartridge body (not labeled) defining an air vent at an upper section thereof and an ink discharge port 1 detachably assembled to a lower section of the cartridge body. When the ink discharge port 1 and/or the cartridge body, especially the ink discharge port 1, is damaged due to abrasion, the ink cartridge need not be discarded as a whole.

Figure 3:
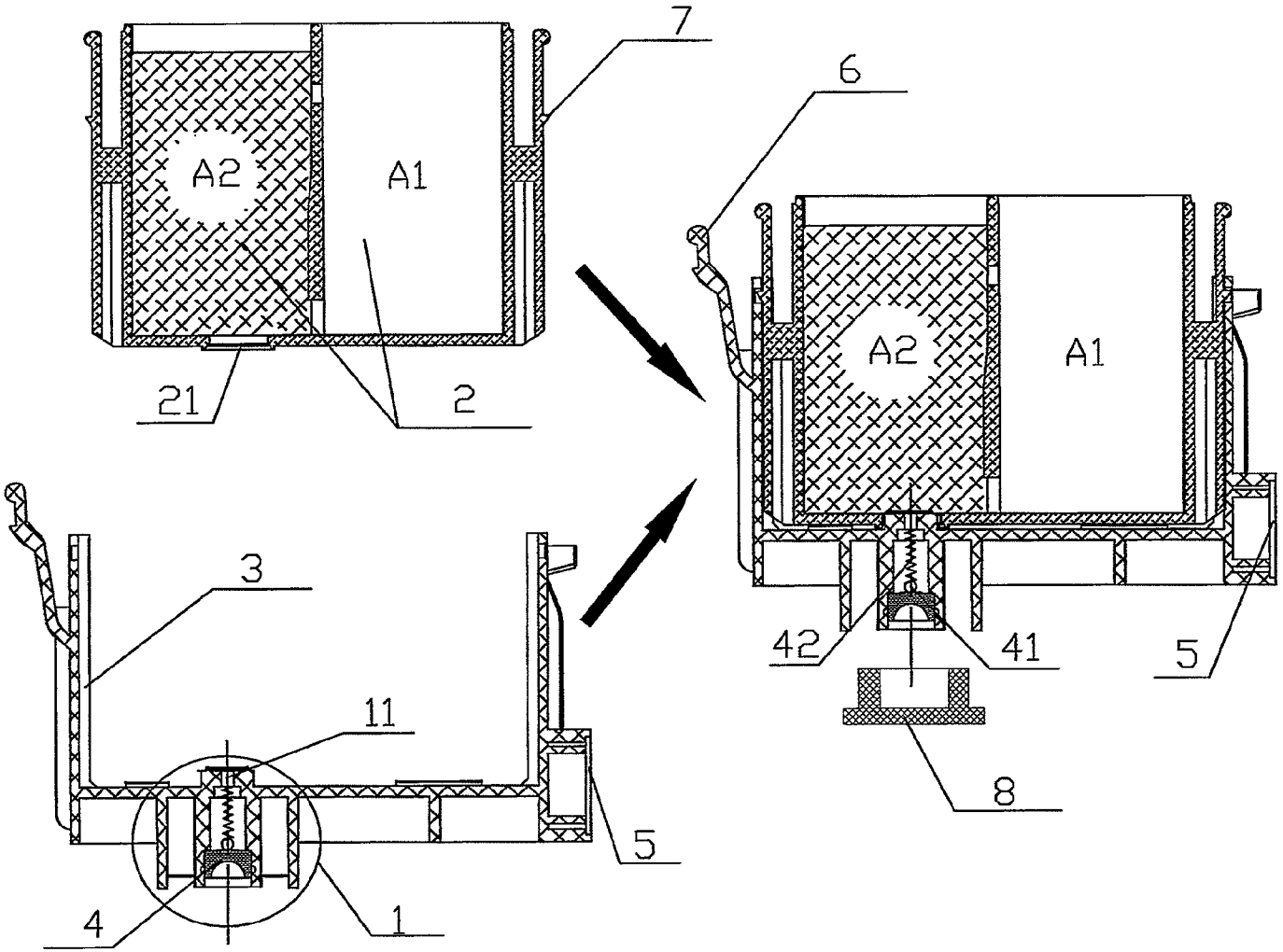
FIG. 3 depicts a sectional view of an ink cartridge in accordance with a second embodiment of the present invention.
Figure 5:
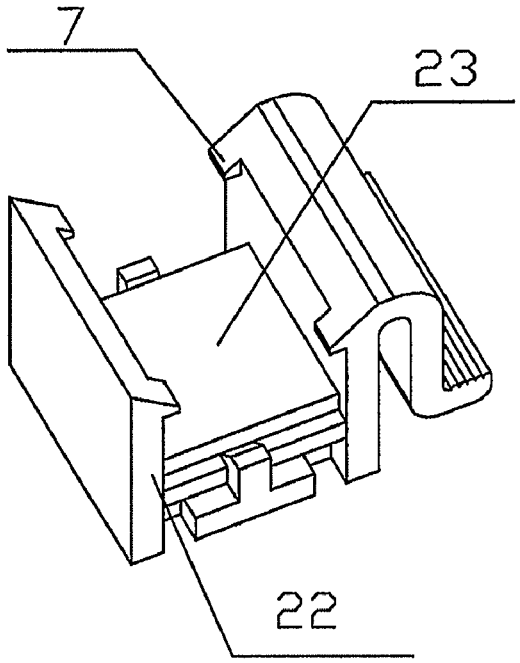
FIG. 5 depicts a perspective view of a protecting shield with an elastic sealing gasket for use in the ink cartridges as shown in FIG. 2 to FIG. 4.
Figure 6:
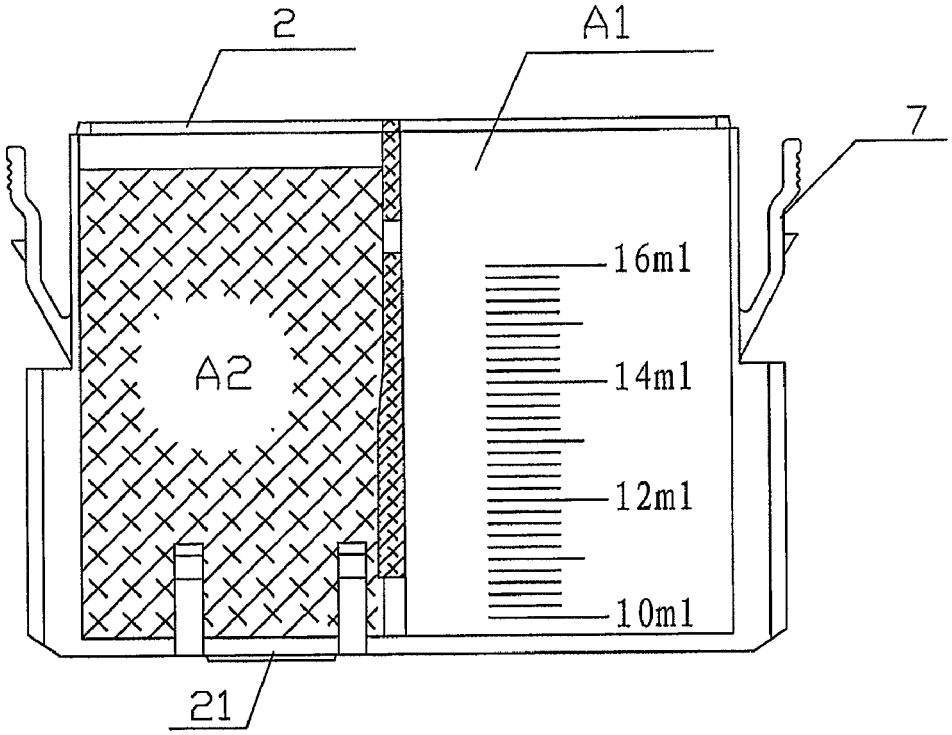
FIG. 6 depicts a front view of a transparent ink accommodating body for use in the ink cartridges shown in FIG. 2 to FIG. 4, showing graduation line set on side wall of the transparent ink accommodating body.

Referring to FIGS. 3 and 5, an ink cartridge according to a second embodiment of the present invention includes a split-type cartridge body having a base 3 and an ink accommodating body 2 properly seated on the base 3. An opening 21 corresponding to the ink discharge port 1 is provided on a lower section of the ink accommodating body 2. A protecting shield 22 with an elastic sealing gasket 23 is assembled to the opening 21. A sealing cover 8 made from elastic material is provided on the ink discharge port 1.

A filter tip 11 with a filter screen 10 is disposed on a top of the ink discharge port 1. A sealing member 4 defining a cone-shaped hole is disposed on the bottom of the ink discharge port 1. The sealing member 4, the globe valve 41 and the spring 42 jointly constitute a one-way valve. The base 3 is formed with a handle 6 thereon, and a chip 5 is disposed on the base 3. The ink accommodating body 2 includes an empty chamber A1 and a storage chamber A2 in communication with the empty chamber A1. The opening 21 is defined at the lower section of the storage chamber A2 filled with fibre cotton. The ink accommodating body 2 is coupled to the base 3 in a lock joint manner. The protecting shield 22 is coupled to the opening 21 in a lock joint manner via engagement between a protrusion 7 of the protecting shield 22 and an edge of the opening 21.

Therefore, the ink cartridge need not be discarded or replaced as a whole when the ink accommodating body 2 or the cartridge body thereof is damaged. If a user does not want to fill the ink in the ink accommodating body 2 after the ink is used up, the user can replace the ink accommodating body 2 with a new one.

Figure 4:
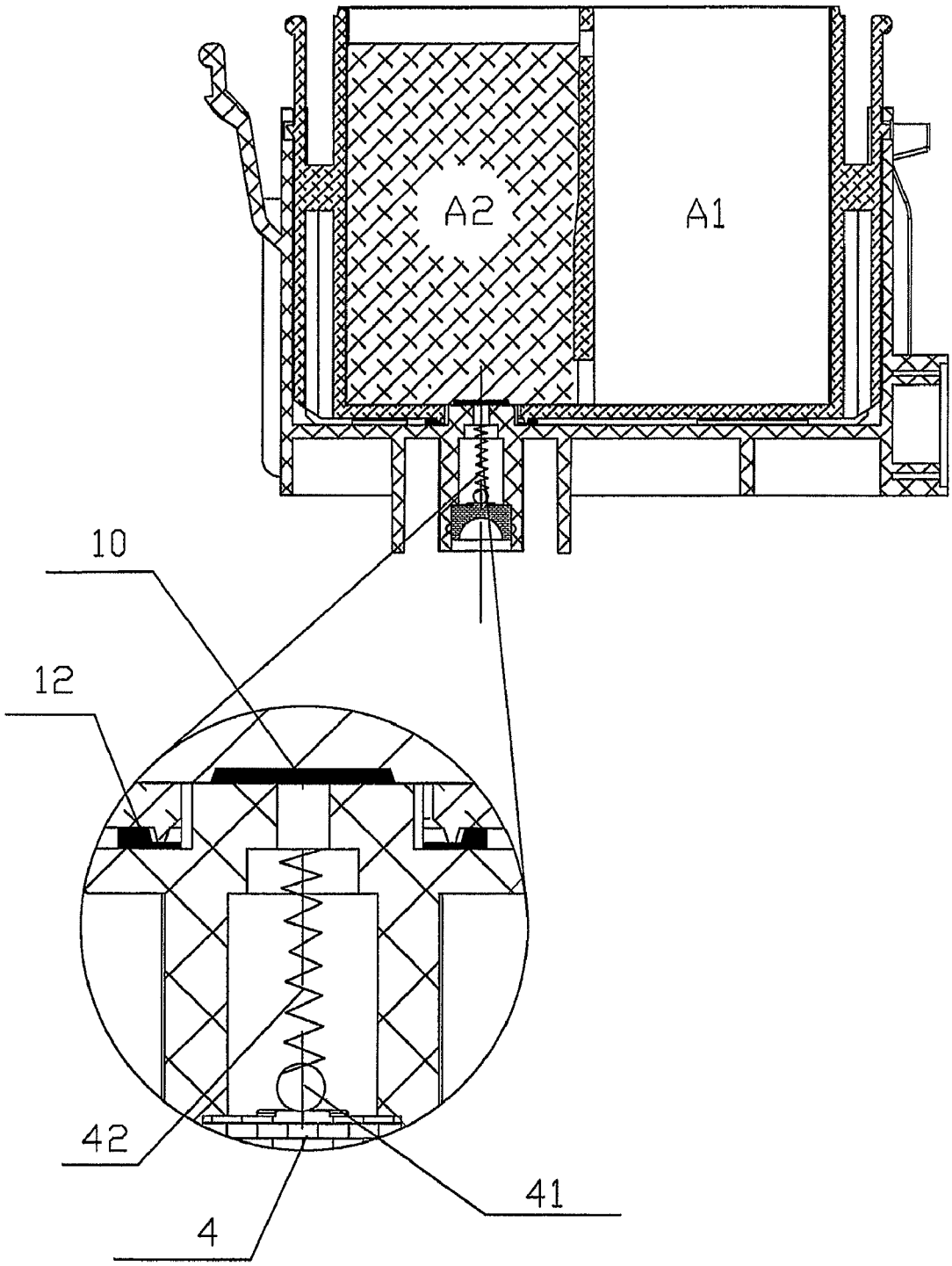
FIG. 4 depicts a sectional view of an ink cartridge in accordance with a third embodiment of the present invention.

Referring to FIGS. 4 and 5, an ink cartridge according to a third embodiment of the present invention is same to the ink cartridge illustrated in the second embodiment of the present invention except that an elastic gasket 12 is disposed around the filter tip 11.

It should be noticed that the ink cartridge according to the present invention may be a unicolor split-type ink cartridge or a multicolor assembly-type ink cartridge. The ink discharge port 1 or the base 3 can be assembled to a printer by a user, and then other components of the cartridge body are installed by the user beforehand. Also, the ink cartridge can be completely assembled in advance, and then the assembled ink cartridge is coupled to the printer.

Referring to FIG. 2, the ink accommodating body 2 is made from transparent material. Graduation line is shown on the side wall of the transparent ink accommodating body 2.

Many modifications and other embodiments of the invention set forth herein will come to mind to one ordinary skill in the art to which this invention pertains having the benefit of the teachings presented in the foregoing descriptions and the associated drawings. Therefore, it is to be understood that the invention is not to be limited to the specific embodiments disclosed herein and that modifications and other embodiments are intended to be included within the scope of the appended claims. Although specific terms are employed herein, they are used in a generic and descriptive sense only and not for the purposes of limitation.

What is claimed is:

1. An ink cartridge, comprising:

a cartridge body defining an air vent at an upper section thereof; and an ink discharge port detachably assembled to a lower section of the cartridge body, wherein the cartridge body comprises a base and an ink accommodating body removably and securely coupled to the base, the ink accommodating body defines an opening corresponding to the ink discharge port;

the ink discharge port is provided with a filter tip and a sealing member having a cone-shaped hole at upper and lower sides thereof, respectively, the filter tip is formed with a filter screen and/or a ceiba fibre;

the filter tip is further formed with an elastic gasket; and a protecting shield having elastic sealing gasket is disposed on the opening.

2. The ink cartridge according to claim 1, wherein the ink accommodating body has an empty chamber and a storage chamber in communication with the empty chamber, the empty chamber and the storage chamber each define an air vent at top thereof, and the opening is located at a lower section of the storage chamber filled with sponge or fibre cotton.

3. The ink cartridge according to claim 2, wherein the ink accommodating body is coupled to the base in a lock joint manner, the protecting shield is coupled to the opening in a lock joint manner.

4. The ink cartridge according to claim 3, wherein the base is formed with a chip.

5. The ink cartridge according to claim 2, wherein a sealing cover made from elastic material is provided on the ink discharge port.

6. The ink cartridge according to claim 2, wherein the cartridge body is formed with a handle, the ink accommodating body is made from transparent material and graduation line is set on the side wall enclosing the empty chamber.

7. The ink cartridge according to claim 2, wherein the base is formed with a chip.

8. The ink cartridge according to claim 1, wherein the base is formed with a chip.

* * * * *